US005812104A

United States Patent [19]

Kapoor et al.

[11] Patent Number: 5,812,104

[45] Date of Patent: Sep. 22, 1998

[54] GRAY-SCALE STEPPED RAMP GENERATOR WITH INDIVIDUAL STEP CORRECTION

[75] Inventors: Mohan L. Kapoor, Orange; Thomas John Rebeschi, North Haven, both of Conn.

[73] Assignee: Northrop Grumman Corporation, Los Angeles, Calif.

[21] Appl. No.: 791,396

[22] Filed: Jan. 30, 1997

Related U.S. Application Data

[63] Continuation of Ser. No. 358,046, Dec. 15, 1994, abandoned, which is a continuation of Ser. No. 241,947, May 12, 1994, abandoned, which is a continuation of Ser. No. 141,428, Oct. 22, 1993, abandoned, which is a continuation of Ser. No. 906,595, Jun. 30, 1992, abandoned.

[51] Int. Cl.[6] ..... G09G 3/30

[52] U.S. Cl. ..... 345/76; 345/77

[58] Field of Search ..... 340/781, 793, 340/760, 767, 713; 315/169.3, 169.4; 313/500, 505, 510; 345/55, 76, 77, 52, 45, 211, 212

[56] References Cited

U.S. PATENT DOCUMENTS

| | | | |
|---|---|---|---|
| 4,061,909 | 12/1977 | Bryant | 364/851 |
| 4,234,821 | 11/1980 | Kako et al. | 315/169.3 |
| 4,554,539 | 11/1985 | Graves | 340/805 |
| 4,631,694 | 12/1986 | Single | 364/608 |
| 4,707,692 | 11/1987 | Higgins et al. | 340/805 |
| 4,841,200 | 6/1989 | Cleary, Jr. et al. | 315/363 |
| 4,864,182 | 9/1989 | Fujioka et al. | 315/169.3 |
| 4,866,348 | 9/1989 | Harada et al. | 315/169.3 |
| 4,975,691 | 12/1990 | Lee | 340/781 |
| 4,982,183 | 1/1991 | Flegal et al. | 340/781 |
| 4,983,885 | 1/1991 | Fujioka et al. | 315/169 |
| 5,075,596 | 12/1991 | Young et al. | 340/781 |

FOREIGN PATENT DOCUMENTS

| | | | |
|---|---|---|---|
| 0310941 | 4/1989 | European Pat. Off. . | |
| 0316822 | 5/1989 | European Pat. Off. . | |
| 0381479 | 8/1990 | European Pat. Off. | 340/781 |

*Primary Examiner*—Chanh Nguyen
*Attorney, Agent, or Firm*—Walter G. Sutcliff

[57] ABSTRACT

Pixel luminance of an electroluminescent display panel is controlled by a row driver applying a voltage equal to the panel's threshold voltage, and column drivers applying the voltage value above the threshold voltage to bring the pixel to the desired luminance. Each column driver independently samples a stepped ramp voltage signal at its own predetermined time selected as a function of the desired luminance. Each column driver then holds the sampled voltage value, and applies to its corresponding column electrode at the appropriate time a voltage equal to the sampled voltage value. The voltage rate of change of each individual step of the stepped ramped voltage signal can be controlled to vary the luminance levels, and to uniformly separate each of the luminance levels.

15 Claims, 5 Drawing Sheets

FIG.2
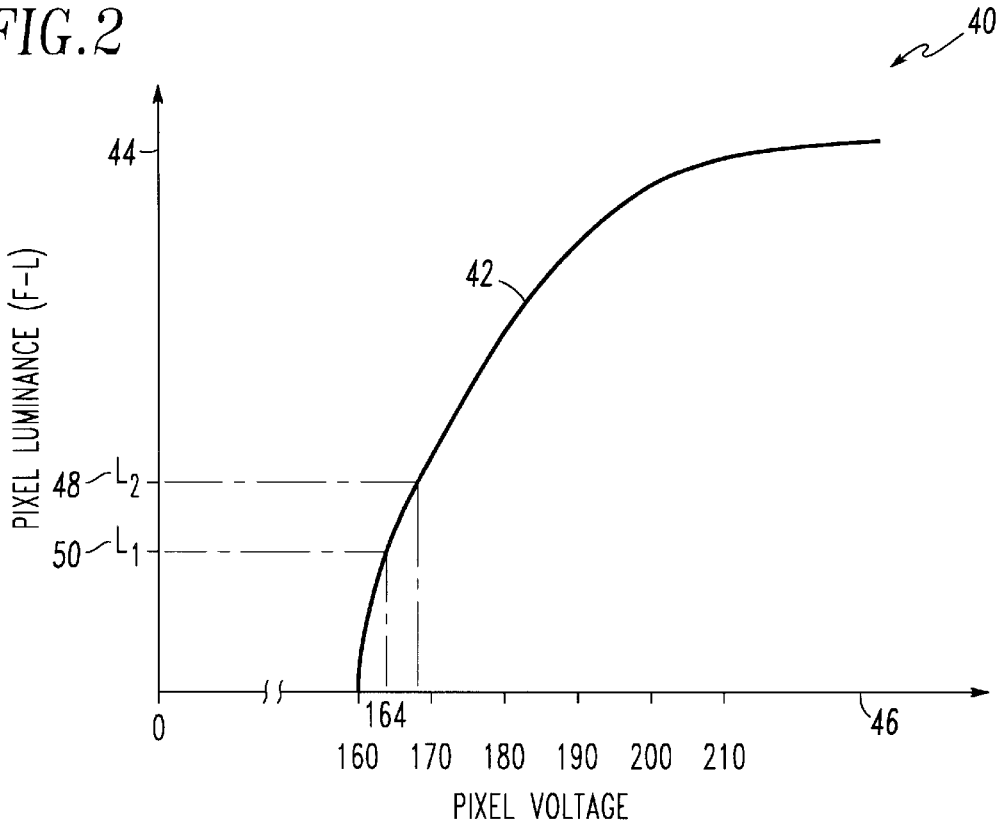
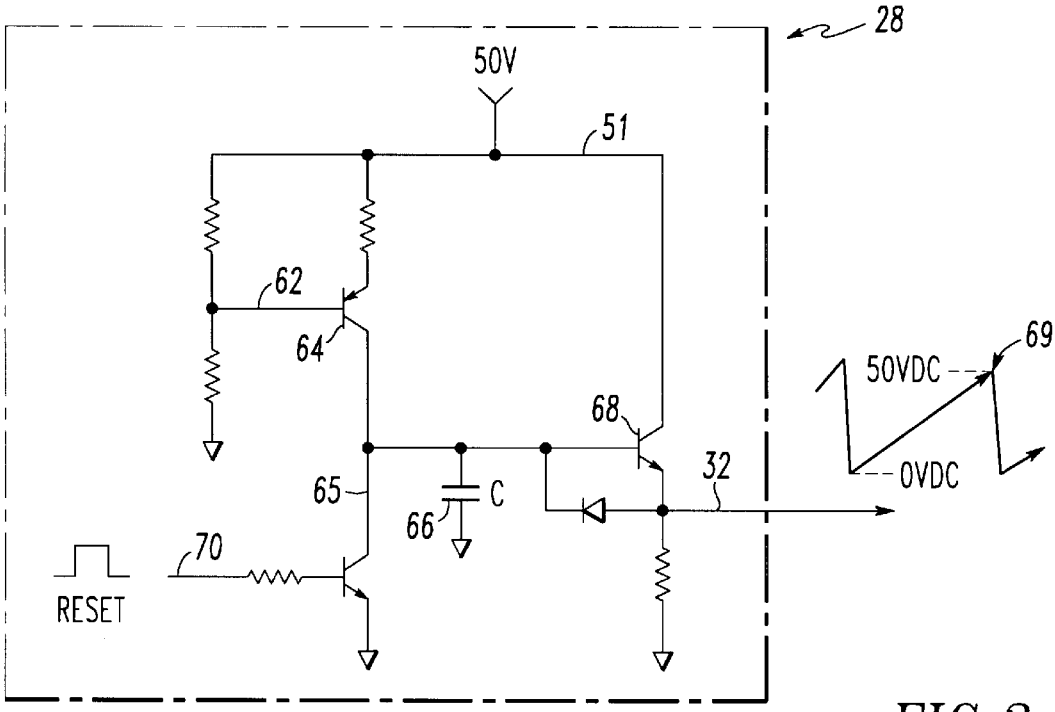
FIG.3
PRIOR ART

FIG.5
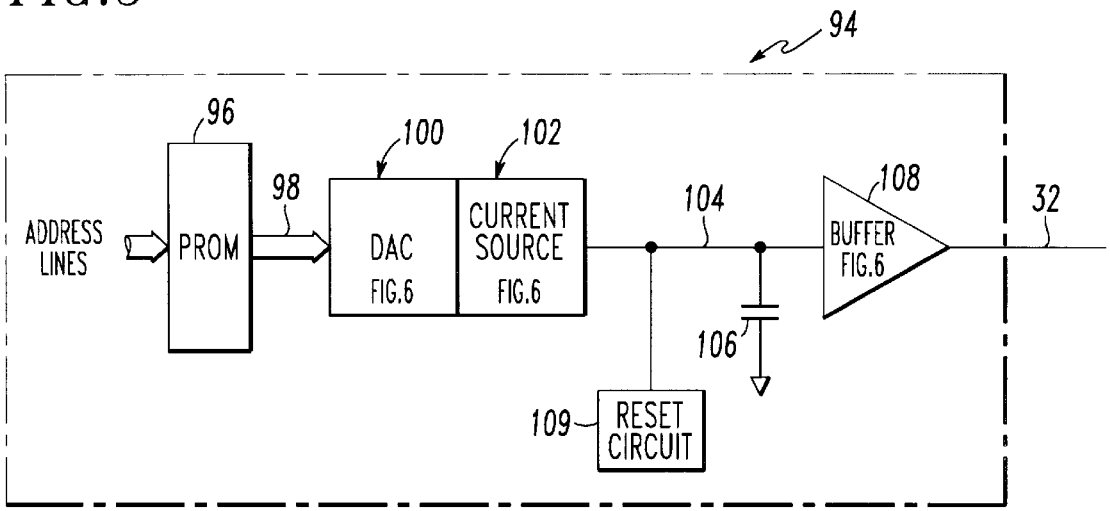
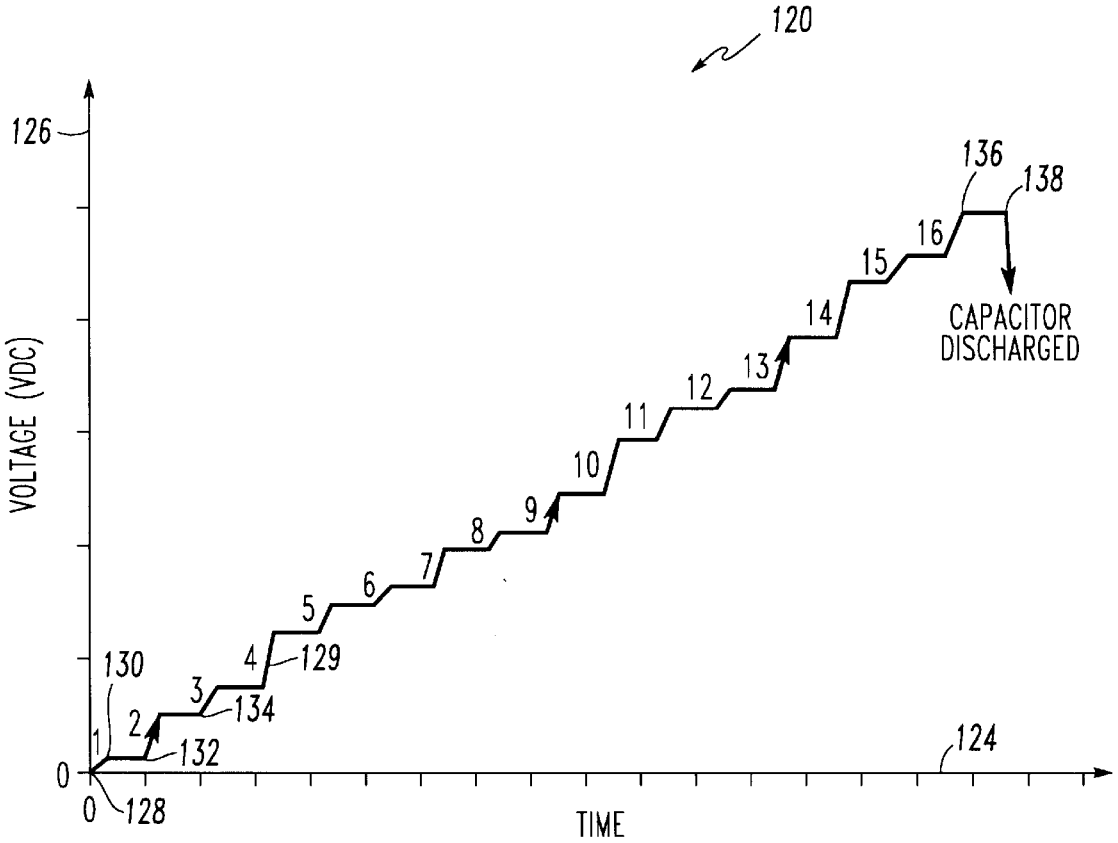
FIG.7

GRAY-SCALE STEPPED RAMP GENERATOR WITH INDIVIDUAL STEP CORRECTION

This application is a continuation of application Ser. No. 08/358,046 filed on Dec. 15, 1994, now abandoned, which is a Rule 62 continuation of Ser. No. 08/241,947 filed May 12, 1994; which is a Rule 62 continuation of Ser. No. 08/141,428 filed Oct. 22, 1993; which is a Rule 62 continuation of Ser. No. 07/906,595 filed Jun. 30, 1992.

CROSS REFERENCE TO RELATED APPLICATIONS

This application contains subject matter related to commonly assigned co-pending application, attorney docket N-1204, Ser. No. 07/906,605, entitled "Symmetric Drive for an Electroluminescent Display Panel" filed even date herewith.

TECHNICAL FIELD

This invention relates to drive circuits for an AC thin film electroluminescent display panels, and more particularly to an improved gray-scale stepped ramp generator for such drive circuits.

BACKGROUND ART

The operation of an AC thin film electroluminescent (TFEL) display panel is based on the principle that a luminescent material (e.g., phosphor) will emit light when a voltage of sufficient magnitude is applied across it. The TFEL display is typically constructed with luminescent material sandwiched between a plurality of row electrodes on one side, and a plurality of column electrodes on the opposite side. Each intersection of the plurality of row and column electrodes defines a pixel. A typical high resolution TFEL display panel may have 512 row electrodes and 640 column electrodes, resulting in 327,680 pixels. Commonly assigned U.S. patent application, Ser. No. 07/897,201, attorney docket number R-3612N, entitled "Low Resistance, Thermally Stable Electrode Structure for Electroluminescent Displays" filed Jun. 11, 1992, discloses the construction of a TFEL display panel.

The luminance of each pixel in the panel is dependent upon the magnitude of the voltage applied across the particular row and column electrode which define the pixel. As a result of this relationship, gray scaling can be achieved by controlling the magnitude of the voltage across the pixel. As an example, each pixel may display one of sixteen luminance levels depending on the magnitude of the voltage applied across the pixel. The magnitude of the minimum voltage required across the pixel before the electroluminescent material will display light is often referred to as the threshold voltage.

Referring to FIG. 1, a thin film electroluminescent (TFEL) display panel system 20 includes a TFEL display panel 22, a plurality of row drivers 24, a plurality of column drivers 26, and a ramp voltage generator 28. A well known method for scanning, often referred to as a row-at-a-time drive scheme places a voltage value equal to the threshold voltage (e.g., −160 vdc or 220 vdc) on the row electrode associated with the particular row to be updated, and applies to the column electrodes a predetermined amount of voltage above the threshold voltage necessary to bring each pixel in the row to its desired luminance.

To control the column driver voltage, the ramp voltage generator 28 typically provides a ramped voltage signal of a fixed duration on a line 32 to each of the plurality of column drivers 26. The ramped voltage signal on the line 32 linearly ramps from zero to fifty volts over the fixed time duration. Each of the column drivers 26 operates as a sample-and-hold device and receives the ramped voltage signal on the line 32, samples it at a predetermined time and retains (i.e., holds) the sampled voltage signal value. The column drivers interface with a controller (not shown) via a bus 34 which contains address, data, and clock lines 35–37 respectively. Each column driver can sample the ramped voltage signal on the line 32 at a different time, and the instant each column driver samples the signal is controlled by the value each receives over the data lines 35. This allows the luminance of the individual pixels 30 in that row to be independently controlled by regulating the magnitude of the voltage placed on each of the plurality of column electrodes 26. The procedure is repeated for each row of pixels, and in general is repeated indefinitely while the panel is powered and displaying information.

FIG. 2 illustrates a plot 40 of the nonlinear relationship between pixel luminance versus voltage across the pixel, along a line 42. Pixel luminance is plotted along a vertical axis 44, and voltage is plotted along a horizontal axis 46. Note that below approximately 160 volts the pixel luminance is zero, and above 160 volts the pixel luminance increases nonlinearly along the line 42 until reaching a maximum at approximately 210 volts. The magnitude of the threshold voltage applied by the row drivers is typically selected to be the voltage (e.g., 160 vdc) above which pixel luminance starts to go non-zero.

To achieve gray-scaling, a plurality of different levels of pixel luminance (e.g., sixteen) are selected along the vertical axis 44 of the plot 40 (FIG. 2). Each of the plurality of levels has a uniquely corresponding voltage value along the horizontal axis 46 which must be applied across the pixel before the pixel can reach the desired luminance. As an example, a first luminance $L_1$ 50 along the vertical axis is one of the plurality of luminance levels, and the $L_1$ luminance level is achieved by applying a voltage of approximately 164 vdc. Similarly, a second luminance level $L_2$ 50 can be achieved by applying a voltage of approximately 168 vdc across the pixel.

U.S. Pat. No. 4,975,691 entitled "Scan Inversion Symmetric Drive" assigned to Interstate Electronics Corp., and U.S. Pat. No. 4,554,539 entitled "Driver Circuit for an Electroluminescent Matrix-Addressed Display" assigned to Rockwell International Corp., both generally disclose how to drive a TFEL panel.

FIG. 3 illustrates a prior art ramp generator 28 which provides a linearly increasing ramp voltage signal whose magnitude is zero to fifty volts. The prior art ramp generator 28 has a fifty volt power rail 51 which provides a constant voltage on a line 62 which is connected to the base of a transistor 64. The voltage on the line 62 biases the transistor 64 causing a constant current to flow at a fixed rate from the transistor's collector on a line 65. This constant current charges a capacitor 66 at the fixed rate, resulting in a linearly increasing ramped voltage on the line 32 from the emitter of a drive transistor 68. Once the voltage ramp signal has reached its peak 69 a reset signal on a line 70 is momentarily enabled to discharge the capacitor 66. This drives the voltage on the line 32 to zero until the reset signal on the line 68 is disabled, and the capacitor 66 begins to charge again at the fixed rate.

A problem with the prior art ramp generator 28 is its lack of ability to vary the constant linear rate of change of the ramped voltage signal on the line 32. Limited variations in the rate of change of ramped voltage signal may be possible if correction circuitry is added to the prior ramp generator 28. However, adding correction circuitry gets expensive quickly as more correction capability is required, which also decreases the reliability of the system due to the additional components. As a result, the prior art ramp generator 28 lacks the ability to vary the values of the sixteen discrete luminance levels (e.g., $L_1$ and $L_2$), thus limiting the gray scaling capability of the TFEL display panel 22 (FIG. 1) to sixteen predetermined luminance values.

SUMMARY OF THE INVENTION

An object of the present invention is to provide a stepped ramp generator which provides a stepped ramp voltage signal for use in controlling pixel luminance in a electroluminescent display panel where the characteristics of the stepped ramp signal can be controlled to vary the plurality of pixel luminance levels.

Another object of the present invention is to provide a plurality of variable luminance levels for each pixel of a thin film electroluminescent display panel.

Yet another object of the present invention is to provide a simplified gray scale stepped ramp generator which provides a plurality of uniformly separated luminance levels in a TFEL display panel.

According to the present invention, the separation of the luminance levels in a electroluminescent display panel are regulated by controlling the variable step rate of a stepped ramp voltage signal which is sampled by a driver circuit to provide a voltage signal value of a certain magnitude to a pixel to achieve the desired pixel luminance.

According further to the present invention, a row driver applies a threshold voltage signal value to a electroluminescent display panel, and a column driver applies a variable voltage value whose magnitude represents the voltage above the threshold voltage at which the desired luminance of the pixel will occur; the column driver operates as a sample and hold device and samples a stepped ramp voltage signal value at a predetermined time, and applies the sampled voltage signal value to achieve the desired voltage across the pixel and hence the desired pixel luminance; the magnitude of each step in the stepped ramp signal is controlled to allow individual step correction, and to allow variation in the plurality of luminance gray scale levels and the separation between each of the luminance levels.

The present invention allows for variation in each of the individual steps in the stepped ramp voltage signal, thus providing the capability to vary each of the luminance levels, and to control the separation between each of the plurality of luminance levels.

These and other objects, features and advantages of the present invention will become more apparent in light of the following detailed description of a best mode embodiment thereof as illustrated in the accompanying drawings.

BRIEF DESCRIPTION OF THE DRAWINGS

FIG. 2 is an plot of the relationship between the TFEL pixel luminance and the voltage applied across the pixel for the TFEL panel display of FIG. 1;

FIG. 3 is an illustration of a prior art analog embodiment of a linear ramp generator of the type used in FIG. 1;

FIG. 5 is a block diagram of an improved gray scale stepped ramp generator according to the present invention for use in the embodiment of FIG. 1;

FIG. 7 is a plot of the stepped ramp voltage signal from the improved gray scale stepped ramp generator of FIG. 6 versus time.

BEST MODE FOR CARRYING OUT THE INVENTION

Figure 1:
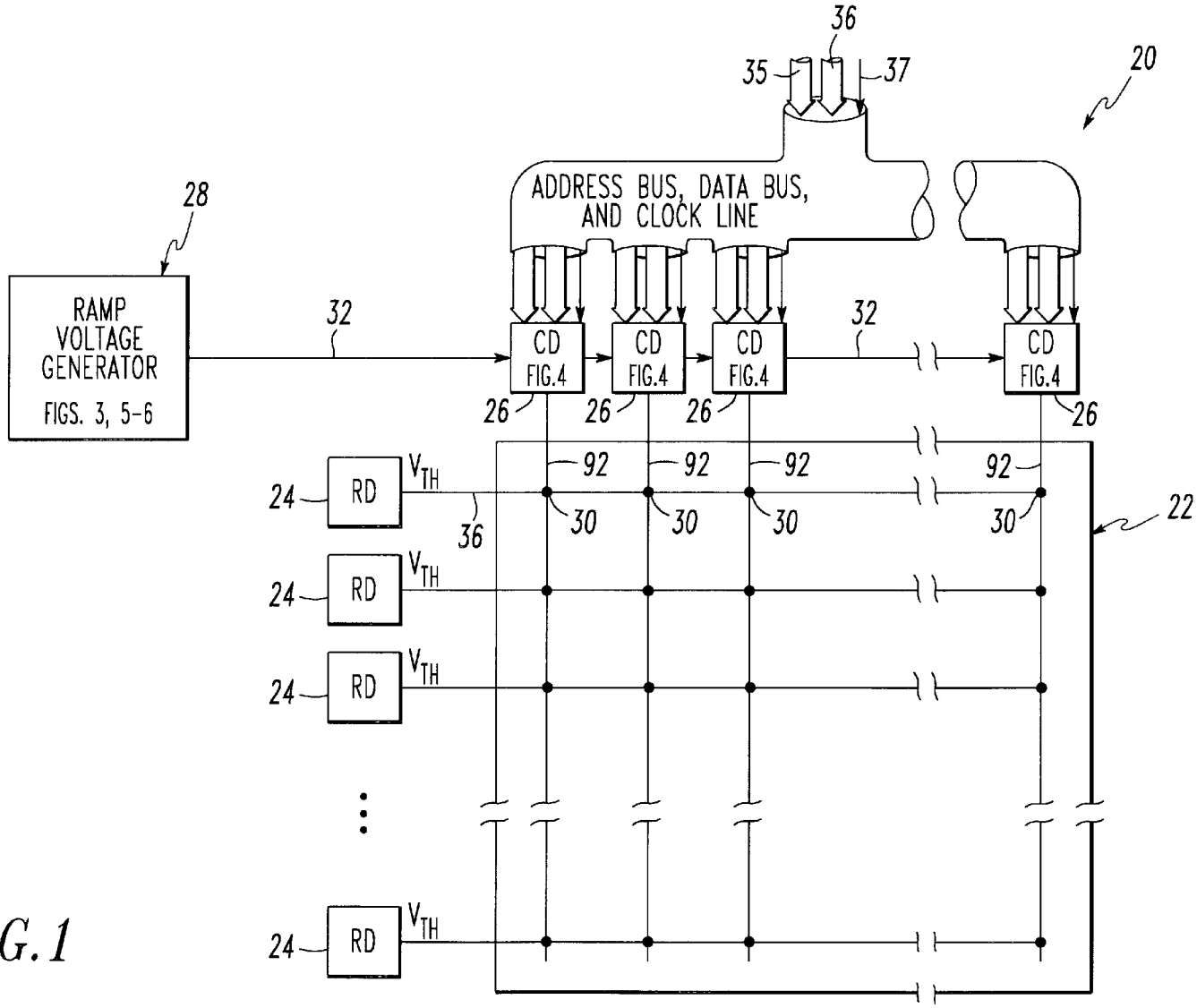
FIG. 1 is an block diagram of a TFEL panel display with the associated plurality of row and column drivers.

Referring again to FIG. 1, the thin film electroluminescent (TFEL) display panel system 20 includes the TFEL display panel 22, the plurality of row drivers 24, the plurality of column drivers 26, and the ramp voltage generator 28.

The display panel 22 is driven in a well known manner utilizing a row-at-a-time drive scheme, where a voltage equal to the threshold voltage (e.g., −160 vdc, or 220 vdc) is placed on the electrode of the row to be written to. This allows the luminance of the individual pixels 30 in the row to be independently controlled by regulating the magnitude of the voltage placed on each of the plurality of column electrodes 26.

Figure 4:
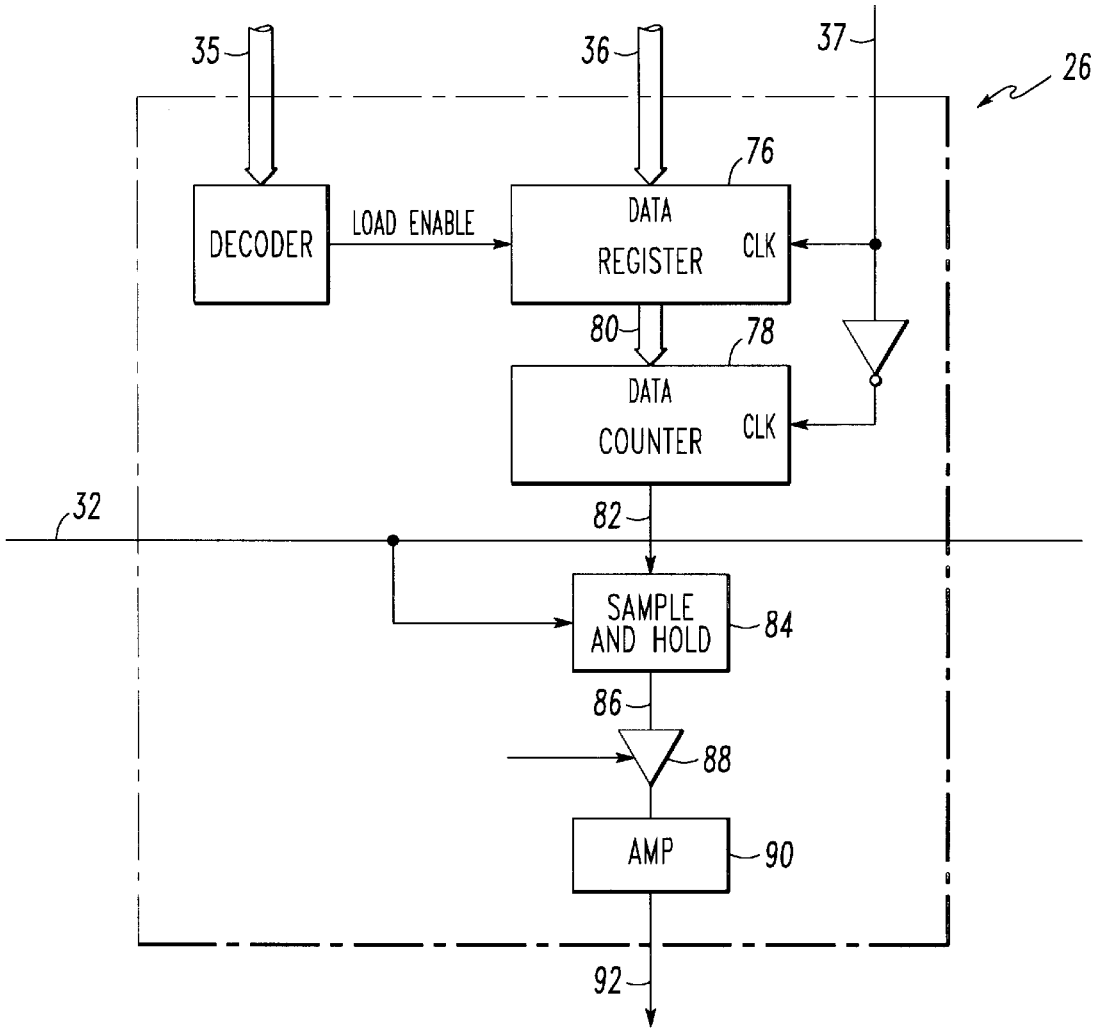
FIG. 4 is a block diagram of the column driver for use in the embodiment of FIG. 1.

FIG. 4 is a block diagram illustration of the column driver 26 of FIG. 1. To control pixel luminance (i.e., gray scaling) a register 76 is loaded with data via the data bus 36, and the data is output to a counter 78 via a plurality of data lines 80. The counter 78 is synchronized with the ramp voltage generator 28 (FIG. 1), such that, the counter starts to decrement when the generator output signal on the line 32 begins ramping from zero volts. The number of data bits and the rate at which the counter is clocked are designed such that when loaded with full counts, the decrementing counter will reach zero counts at the moment the ramp voltage signal value on the line 32 reaches fifty volts. This allows direct control of pixel luminance since the number of bits loaded into the counter controls the amount of voltage above the threshold voltage that will be applied across the pixel.

When the counter 78 reaches zero counts it sends a signal on a line 82 to a sample-and-hold circuit 84 which samples the signal on the line 32 and holds the sampled signal value. The sample-and-hold 84 provides the sampled signal value on a line 86 to a three state line driver 88 (i.e., a Texas Instruments SN54S244 line driver with 3-state outputs) which provides a signal to an amplifier 90. The amplifier 90 provides the column driver output signal on a line 92. An example of a column driver available on an integrated circuit is the 16-Channel Matrix TFEL Panel Display Column Driver, model number HV01, manufactured by Supertex, Inc. The HV01 column driver has a 4-bit counter which allows for sixteen selectable luminance levels.

As discussed hereinbefore, a problem with the prior art ramp generator 28 (FIG. 3) is its lack of ability to adequately vary the rate of the ramped voltage signal from its constant value through out the ramp.

FIG. 5 is a block diagram illustration of a gray-scale stepped ramp voltage generator 94 having the ability to provide the individual step correction of the present invention. An electronic memory device such as, for example, PROM 96 responsive to the address bus (e.g., 5 bits) provides data on a plurality of data lines 98 to a digital-to-analog convertor (DAC) 100. The DAC provides an analog signal to a current source 102 which in turn provides a current signal on the line 104 to a capacitor 106 and a high input impedance buffer 108. The magnitude of the current on the line 104 is controlled by the data value on the plurality of lines 98. The current on the line 104 sets the rate the capacitor 106 charges resulting in a controlled voltage output signal on the ramp generator output line 32. The capacitor is discharged in preparation for another ramp by enabling a reset circuit 109.

Figure 6:
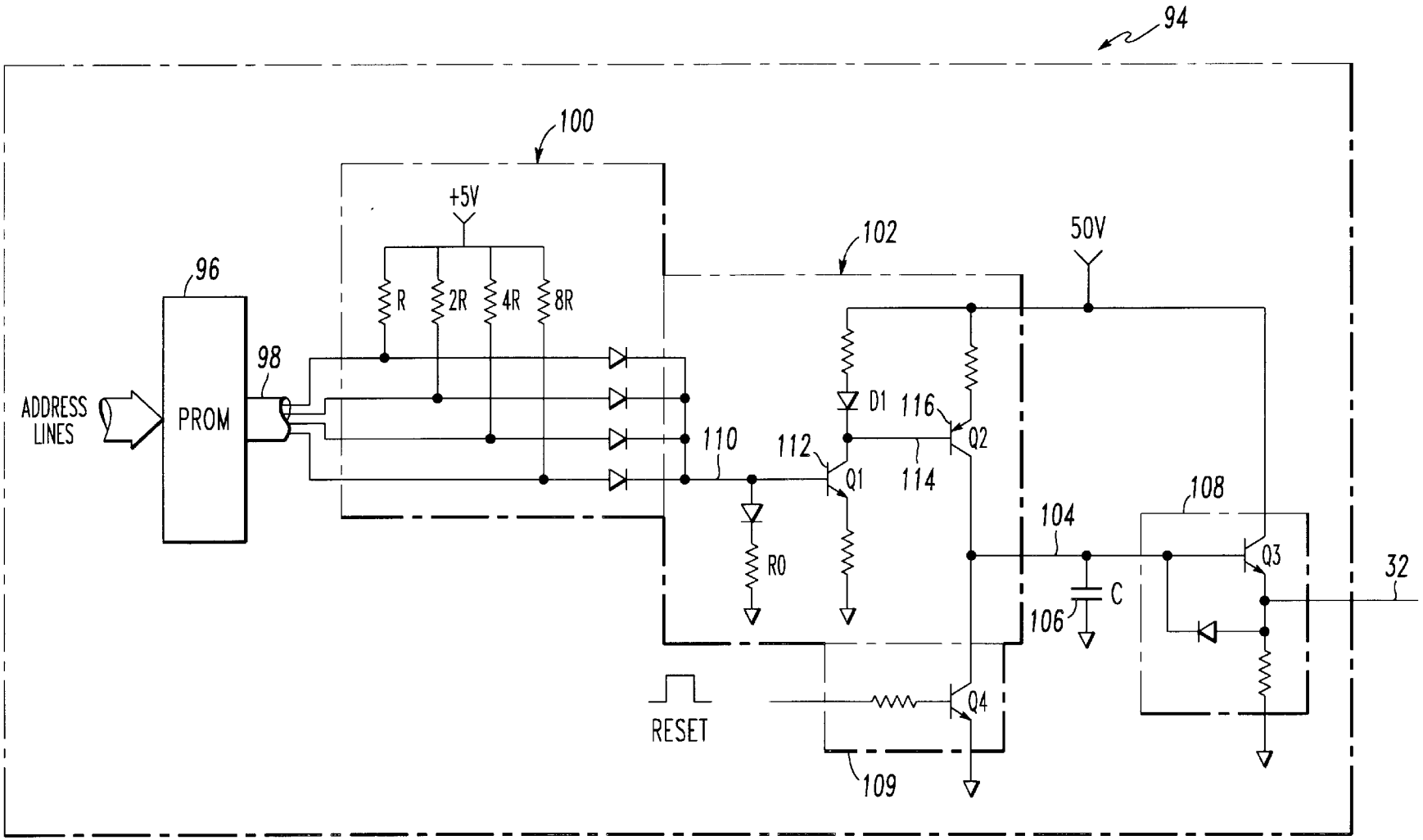
FIG. 6 is an illustration of a preferred embodiment of the improved gray scale stepped ramp generator of FIG. 5.

FIG. 6 illustrates a preferred detailed embodiment of the gray-scale stepped ramp generator 94 of FIG. 5. The PROM 96 is addressed by the address bus and provides binary data on the plurality of lines 98. The DAC 100 is a well known ladder network which converts the digital PROM output to an analog voltage signal value on a line 110. The voltage on the line 110 biases a transistor 112 to provide a voltage signal value on a line 114 which controls the flow of current through a drive transistor 116 operating in its active region. Current from the drive transistor 116 charges the capacitor 106 at a rate set as a function of the magnitude of the voltage value on the line 110. As the capacitor 106 charges, the magnitude of the voltage on the line 104 increases causing the output signal value on the line 32 from the buffer 108 to also increase. The PROM output is applied for a fixed pulse width allowing the signal on the line 104 to integrate up to one of the programmable step levels at which time the PROM outputs zero counts which holds the signal on the line 32 constant until the next non-zero from output is applied. This cycle is repeated until the sixteen programmable steps are completed (i.e., the signal on the line 32 reaches 50 vdc), at which time the reset circuit 109 is momentarily enabled to discharge the capacitor 106, and then disabled to begin a new voltage ramp.

In practice of the invention, the number of PROM output lines determines the number of step rates selectable for any step in the ramped voltage signal. As an example, with the four data lines from the PROM 96 to the DAC 100, there are sixteen possible discrete voltage values that can be placed on the line 110. Each of these sixteen voltage values provides its own rate of charge to the capacitor 106, allowing the controller (not shown) to select any one the sixteen possible rates of charge. Similarly, if thirty-two step rates are required, the PROM must have at least five digital outputs lines. Generally, the more PROM output lines there are, the greater the individual step correction ability of the present invention. An example of how the preferred detailed embodiment of FIG. 6 generates the stepped ramp voltage signal is now in order.

FIG. 7 illustrates a plot 120 of a complete stepped ramp voltage signal provided on line 32 (FIG. 6). Time is plotted along a horizontal axis 124 and, and stepped ramp voltage signal value is plotted along a vertical axis 126. Referring to FIGS. 6–7, assume the capacitor 106 is completely discharged, and the reset circuit 109 is disabled. At time equal zero 128, the PROM 96 receives a first address and outputs data which provides a certain voltage value on the line 110, and hence a certain current starts charging the capacitor 106 at a fixed rate corresponding to the PROM address. As the capacitor charges the voltage signal value on the line 32 (FIGS. 1&6) starts to increase along a line 129.

A fixed time T (e.g., seventy-five nanoseconds) later at a point 130 on the line 129, zero volts DC is placed on the line 110 and the voltage across the capacitor 106 is held constant. The second step starts at a point 132 along the line 129, and the capacitor begins to charge at a rate determined by the current PROM address. A fixed time T later the voltage on the line 110 is again set equal to zero volts and the voltage across capacitor remains constant until the third step. The third step is initiated at a point 134 along the line 129 and the capacitor again begins to charge at one of the sixteen selected rates for a fixed time period T. This series of steps continues until the ramped voltage signal on the line 32 reaches fifty volts at a point 136 on the line 129. At the end of the sixteen steps shown at point 138 along the line 129, the reset circuit 109 is enabled and the capacitor is discharged in preparation for another stepped ramp.

Upon inspection of FIG. 7, one can see the difference in the various step sizes during each of the sixteen voltage steps along the line 129. During each of the sixteen steps in the ramped voltage signal along the line 129, the rate at which the capacitor charges can be any one of the sixteen possible charging rates which is selected by addressing the appropriate PROM address. As an example, note the capacitor charges at a slower rate in step one from point 128 to 130 along the line 129, than it does in step two which begins at the point 132. This variable control over the capacitor charging rate provides the designer with the flexibility of selecting any sixteen desired luminance levels along the line 42 in FIG. 2.

It should be understood that while the embodiment disclosed herein uses four PROM output lines to provide sixteen possible capacitor charging rates, the invention is clearly not so limited. It is anticipated that in some circumstances two or three PROM outputs will be used where less correction capability is required, while in other circumstances five or more PROM output lines will be used when additional step correction capability is required. In addition, while the preferred embodiment of the present invention utilizes a PROM, one of ordinary skill in the art will certainly appreciate that a PROM is one of many possible alternatives for decoding which of the plurality of rates the capacitor is commanded to charge at. In fact an electronic memory device such as, for example, a decoder chip, a programmable logic array chip, a EEPROM, a UVPROM or a ROM are all alternates to a PROM. Furthermore, while the invention has been described with respect to the row drivers applying the threshold voltage and the column drivers applying the variable voltage value, one skilled in the art will appreciate that the invention is clearly not so limited, and that an alternative embodiment may have the column drivers apply the threshold voltage and the row drivers apply the variable voltage value.

Although the present invention has been shown and described with respect to a best mode embodiment thereof, it should be understood by those skilled in the art that various other changes, omissions and additions to the form and detail thereof, may be made therein without departing from the spirit and scope of the present invention.

We claim:

1. An electroluminescent display panel gray scale drive circuit which generates a stepped ramp voltage signal having a fixed duration, each step having a variable magnitude and charging rate, for controlling the separation of possible luminance levels across a pixel using pulse amplitude modulation, comprising:

a row driver;

a column driver which combines with said row driver to provide a variable voltage value across the pixel, and is responsive to the stepped ramp voltage signal; said column driver including a sampling circuit sampling the stepped ramp voltage signal at a time determined by a desired pixel luminance to generate a pulse amplitude modulated column driving voltage;

a holding circuit holding the pulse amplitude modulated column driving voltage sampled by said sampling circuit; and an applying circuit applying the pulse amplitude column driving voltage held by said holding circuit to a column electrode to achieve the desired pixel luminance;

a stepped ramp voltage generator, connected to said column driver, for generating the stepped ramp voltage signal value, including means for generating a predetermined pattern of digital data on a plurality of data lines;

means for converting said predetermined pattern of digital data to an analog signal value, said converting means being operably connected to said generating means; and means for integrating over time said analog signal value to provide the stepped ramp voltage signal value, said integrating means being operably connected to said converting means; said stepped ramp voltage generator providing each step of the stepped ramp voltage signal with a variable step voltage magnitude and a variable step voltage charging rate.

2. The gray scale drive circuit of claim 1, wherein said means for generating includes an electronic memory device connected to an address bus for generating said predetermined pattern of digital data on a plurality of data lines;

said means for converting includes a digital-to-analog converter responsive to said predetermined pattern of digital data on said data line for converting said binary data to said analog signal value; and means for integrating includes a capacitor disposed to receive said analog signal value and integrate over time said analog signal value to provide said stepped ramp voltage signal.

3. The gray scale drive circuit of claim 2 further comprising a reset circuit for discharging said capacitor on command.

4. The gray scale drive circuit of claim 2 wherein said means for generating further comprises a ROM.

5. The gray scale drive circuit of claim 2 wherein said means for generating further comprises a programmable logic array.

6. The gray scale drive circuit of claim 1, said column driver further including:

a register receiving the desired pixel illuminance, a counter programmed with the desired pixel illuminance from said register and synchronized with said stepped ramp voltage generator, wherein when said counter reaches a zero count, said counter instructs said sampling circuit to sample the stepped ramp voltage signal at that time to generate the pulse amplitude modulated column driving voltage.

7. An electroluminescent display panel drive circuit which generates a stepped ramp voltage waveform signal having a variable magnitude and charging rate for controlling the separation between a plurality of pixel luminance levels using pulse amplitude modulation, comprising:

first driver means, for applying to a display panel electrode a voltage signal value substantially equal to the threshold voltage of the electroluminescent display panel;

second driver means, responsive to the stepped ramp voltage signal of a variable magnitude for combining with said first driver means to provide a variable voltage of a certain value across a certain display panel pixel to achieve a desired luminance, said second driver means including a sampling circuit sampling the stepped ramp voltage signal at a time determined by the desired pixel luminance to generate a pulse amplitude modulated driving voltage;

a holding circuit holding the pulse amplitude modulated driving voltage sampled by said sampling circuit;

an applying circuit applying the pulse amplitude modulated driving voltage held by said holding circuit to a corresponding pixel electrode to achieve the desired pixel luminance; and means for generating the stepped ramp voltage signal of a variable magnitude by generating a predetermined pattern of digital data on a plurality of data lines, for converting said predetermined pattern of digital data to an analog signal value and providing an analog signal value indicative thereof, and for integrating over time said analog signal value to provide the stepped ramp voltage signal.

8. The display panel drive circuit of claim 7 wherein said means for generating further comprises an electronic memory device for providing said predetermined pattern of digital data;

a digital-to-analog converter for converting said predetermined pattern of digital data to an analog voltage signal value; and a current source responsive to said analog voltage signal value for providing said analog signal value.

9. The display panel drive circuit of claim 8 wherein said means for generating further comprises a capacitor for integrating said analog signal value over time and providing said stepped ramp voltage signal of a variable magnitude.

10. The display panel drive circuit of claim 9 wherein said first driver means is a row driver and said second driver means is a column driver.

11. The display panel drive circuit of claim 9 wherein said first driver means is a column driver and said second driver means is a row driver.

12. The display panel drive circuit of claim 9 further comprising a reset circuit for discharging said capacitor.

13. The display panel circuit of claim 9 wherein said electronic memory device comprises a ROM.

14. The display panel circuit of claim 9 wherein said electronic memory device comprises a programmable logic array.

15. The display panel drive circuit of claim 7, a register receiving the desired pixel illuminance, a counter programmed with the desired pixel illuminance from said register and synchronized with said stepped ramp voltage generator, wherein when said counter reaches a zero count, said counter instructs said sampling circuit to sample the stepped ramp voltage signal at that time to generate the pulse amplitude modulated driving voltage.

* * * * *